US011158288B2

(12) United States Patent
Tada

(10) Patent No.: US 11,158,288 B2
(45) Date of Patent: Oct. 26, 2021

(54) DISPLAY APPARATUS, CONTROL METHOD OF DISPLAY APPARATUS, AND NON-TRANSITORY COMPUTER READABLE MEDIUM HAVING TEMPERATURE CORRECTION

(71) Applicant: CANON KABUSHIKI KAISHA, Tokyo (JP)

(72) Inventor: Mitsuru Tada, Machida (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/939,413

(22) Filed: Jul. 27, 2020

(65) Prior Publication Data

US 2021/0035528 A1 Feb. 4, 2021

(30) Foreign Application Priority Data

Jul. 29, 2019 (JP) ..... JP2019-138736

(51) Int. Cl.
*G09G 3/36* (2006.01)
*G09G 5/10* (2006.01)

(52) U.S. Cl.
CPC ..... *G09G 5/10* (2013.01); *G09G 3/3603* (2013.01); *G09G 2320/0233* (2013.01); *G09G 2320/041* (2013.01); *G09G 2320/0626* (2013.01)

(58) Field of Classification Search
CPC ..... G09G 2320/0233; G09G 2320/041; G09G 2320/0626; G09G 3/3603; G09G 5/10;
(Continued)

(56) References Cited

U.S. PATENT DOCUMENTS 8,937,587 B2 1/2015 Nakajima
2008/0062070 A1* 3/2008 De Oto ..... H05B 47/18 345/46

(Continued)

FOREIGN PATENT DOCUMENTS

JP 2012-159604 A 8/2012
JP 6120552 B2 4/2017
JP 6185636 B2 8/2017

*Primary Examiner* — Richard J Hong
(74) *Attorney, Agent, or Firm* — Cowan, Liebowitz & Latman, P.C.

(57) ABSTRACT

The invention is a display device and method for correcting the amount of emitted light and brightness level from multiple light sources, which illuminate an object that is being imaged and displayed by a display module. The device and system include multiple temperature sensors that correspond to each of the multiple positions in the display module. The device and system also include a computer processor, which operates as a correction unit to individually correct the brightness for each of the multiple light sources based on the detected temperatures, detected by the temperature sensors, respectively, and the dispersion of the plurality of temperatures. The correction unit also performs (1) the temperature correction processing, to individually correct each of the multiple measured temperatures based on the dispersion; and (2) the brightness correction processing, to individually correct each of the brightness levels of the multiple light sources based on the corrected temperatures.

14 Claims, 7 Drawing Sheets

(58) Field of Classification Search
CPC .. G09G 3/3208; G09G 3/3233; G09G 3/3283; G09G 3/3225; G09G 3/36; G09G 3/3611; G09G 3/3413; G09G 3/3426; H05B 31/50; H05B 47/18; H05B 45/18; G06F 1/1637; G01J 1/4257; G01K 13/00
See application file for complete search history.

(56) References Cited

U.S. PATENT DOCUMENTS

2008/0231558 A1* 9/2008 Naugler ..... G09G 3/3233 345/76
2010/0259572 A1* 10/2010 Yang ..... G09G 3/3413 345/697
2010/0265228 A1* 10/2010 Kimura ..... G09G 3/3233 345/207
2011/0163691 A1* 7/2011 Dunn ..... H05B 45/18 315/297
2012/0154453 A1* 6/2012 Yamashita ..... G09G 3/3225 345/690
2012/0212520 A1* 8/2012 Matsui ..... G09G 3/3611 345/690
2012/0236044 A1* 9/2012 Nagashima ..... G09G 3/3413 345/690
2012/0274544 A1* 11/2012 Nakajima ..... H05B 31/50 345/101
2013/0016306 A1* 1/2013 Ohno ..... G09G 3/3426 349/61
2013/0181961 A1* 7/2013 Fujinaka ..... G09G 3/3426 345/207
2015/0130866 A1* 5/2015 Bae ..... G09G 3/3225 345/694
2015/0379940 A1* 12/2015 Kishi ..... G09G 3/3283 345/690
2017/0032723 A1* 2/2017 Kim ..... G09G 3/3208
2018/0042088 A1* 2/2018 Uchiike ..... G01J 1/4257
2018/0218662 A1* 8/2018 Hu ..... G09G 3/36
2018/0277047 A1* 9/2018 Dai ..... G09G 3/36
2019/0103062 A1* 4/2019 Li ..... G01K 13/00
2019/0189042 A1* 6/2019 Aurongzeb ..... G06F 1/1637
2019/0362671 A1* 11/2019 Kuki ..... G09G 3/3233
2020/0193904 A1* 6/2020 Kho ..... G09G 3/3233

* cited by examiner

FIG.3

| TKmn—Tavg | Kmn |
|---|---|
| 0 OR LESS | 0.00 |
| 1 | 0.01 |
| ··· | ··· |
| 10 | 0.80 |
| 11 | 0.85 |
| ··· | ··· |
| 65 | 1.00 |

FIG.4

| TEMPERATURE [°C] | BRIGHTNESS (NORMALIZED VALUE) |
|---|---|
| 0 | 1.10 |
| 1 | 1.09 |
| ··· | ··· |
| 23 | 1.00 |
| 24 | 0.99 |
| ··· | ··· |
| 65 | 0.90 |

DISPLAY APPARATUS, CONTROL METHOD OF DISPLAY APPARATUS, AND NON-TRANSITORY COMPUTER READABLE MEDIUM HAVING TEMPERATURE CORRECTION

BACKGROUND OF THE INVENTION

Field of the Invention

The present invention relates to a display apparatus, a control method of the display apparatus, and a non-transitory computer readable medium

Description of the Related Art

In a liquid crystal display apparatus, a control, to suppress the brightness change of LEDs, which is used for the light source (the backlight module) of the liquid crystal display apparatus, caused by the temperature change of the LEDs, is performed. In this control, in order to suppress the brightness fluctuation of each one of at least several hundred LEDs, the brightness value of each LED is detected using over a dozen inexpensive brightness sensors.

Recently the high dynamic range (HDR) standard has been established, and a 1000 nit or higher brightness is required for a display apparatus to satisfy the HDR standard. In other words, in the case of a liquid crystal display apparatus conforming to the HDR standard, a number of LEDs used for the backlight module must be increased more than the conventional model conforming to the standard dynamic range (SDR) standard.

If the number of LEDs is increased, the packaging density of the LEDs on a substrate mounted on the backlight module increases, and in some cases, a plurality of brightness sensors cannot be mounted on the substrate. In this case, the conventional processing to suppress the brightness change (brightness fluctuation) using the brightness sensors and temperature sensors cannot be performed. A possible alternative is to correct the brightness values of the LEDs using only relatively small temperature sensors which can be mounted on the substrate.

A technique to individually control the brightness value of each sub-region of the backlight module in accordance with the brightness level of the image signal is available, and this control is called "local diming control (LD control)". In the case of performing the LD control, the in-plane brightness distribution (e.g. brightness value distribution of the plurality of LEDs) of the backlight module changes in accordance with the image signal, hence the in-plane temperature distribution of the backlight module also changes.

Generally in the case of the LD control ON (in the case where LD control is performed), the in-plane temperature difference in the backlight module increases, but the heat generation value of the entire backlight module decreases compared with a case of the LD control OFF (in the case where LD control is not performed). The heat dissipation performance of the backlight module, on the other hand, is approximately the same whether LD control is ON or OFF. This means that the heat generation value of the backlight module is decreased by the LD control while maintaining a sufficient heat dissipation performance, even if the entire backlight module emits light. Therefore in the case of the LD control ON, compared with the case of the LD control OFF, the ratio of the heat dissipation value with respect to the heat generation value increases, and the sensor temperature (detection value of the temperature sensor: temperature detected by the temperature sensor) decreases. As a result, the margin of error of the sensor temperature (difference between the actual temperature and the sensor temperature) increases, and the correction error of the brightness is increased by correcting the brightness values of the LEDs based on the sensor temperature values having a large margin of error.

The technique to correct the brightness value of the light source using the temperature sensor is disclosed in Japanese Patent No. 6185636 and No. 6120552. Japanese Patent No. 6185636 discloses a technique to decrease the brightness value of the light source when the sensor temperature value is higher than a threshold. Japanese Patent No. 6120552 discloses a technique to determine the brightness sensor used for measurement with priority in accordance with the temporal change of the sensor temperature value, to correct the sensor brightness value (detection value of the brightness sensor) using the sensor temperature value, and to correct the brightness value of the light source using the corrected sensor brightness value.

However in the case of the techniques disclosed in Japanese Patent No. 6185636 and No. 6120552, a margin of error of the sensor temperature value caused by the brightness value of the light source is not considered, and the sensor temperature value is assumed to be correct. In concrete terms, in the case of the technique disclosed in Japanese Patent No. 6185636, the brightness value of the light source is corrected using the sensor temperature value without any correction. In the case of the technique disclosed in Japanese Patent No. 6120552, the brightness value is corrected using the sensor temperature value without correction, and the brightness value of the light source is corrected using the corrected sensor brightness value. As a result, the brightness value of the light source (LED) cannot be corrected at high precision. Particularly in the case of the LD control ON, where the margin of error of the temperature sensor increases, a brightness value of the light source cannot be corrected at high precision.

SUMMARY OF THE INVENTION

The present invention provides a technique to correct the brightness value of the light source at high precision, even if a margin of error caused by the brightness value of the light source is included in the sensor temperature value (detection value of the temperature sensor value:temperature detected by temperature sensor).

The present invention in its first aspect provides a display apparatus comprising:

a display module configured to display an image by causing a plurality of light sources to emit light;

a plurality of temperature sensors corresponding to a plurality of positions in the display module respectively; and at least one memory and at least one processor which function as: a correction unit configured to individually correct each of brightnesses of the plurality of light sources based on a plurality of temperatures detected by the plurality of temperature sensors respectively and dispersion of the plurality of temperatures.

The present invention in its second aspect provides a control method of a display apparatus including: a display module configured to display an image by causing a plurality of light sources to emit light; and a plurality of temperature sensors corresponding to a plurality of positions in the display module respectively, the control method comprising:

acquiring a plurality of temperatures detected by the plurality of temperature sensors respectively; and individually correcting each of brightnesses of the plurality of light sources based on the plurality of temperatures and dispersion of the plurality of temperatures.

The present invention in its third aspect provides a non-transitory computer readable medium that stores a program, wherein the program causes a computer to execute a control method of a display apparatus including: a display module configured to display an image by causing a plurality of light sources to emit light; and a plurality of temperature sensors corresponding to a plurality of positions in the display module respectively, the control method comprising:

acquiring a plurality of temperatures detected by the plurality of temperature sensors respectively; and individually correcting each of brightnesses of the plurality of light sources based on the plurality of temperatures and dispersion of the plurality of temperatures.

Further features of the present invention will become apparent from the following description of exemplary embodiments with reference to the attached drawings.

BRIEF DESCRIPTION OF THE DRAWINGS

FIG. 3 is a table indicating a difference (TKmn−Tavg) and a coefficient Kmn according to Embodiment 1;

FIG. 4 is a table indicating a temperature characteristic table according to Embodiment 1;

DESCRIPTION OF THE EMBODIMENTS

Embodiment 1

Embodiment 1 of the present invention will be described. Here an example of applying the present invention to a liquid crystal display apparatus will be described, however a display apparatus to which the present invention is applicable is not limited to a liquid crystal display apparatus. For example, the present invention may be applied to another transmission type display apparatus, such as a micro-electro mechanical system (MEMS) shutter type display apparatus which uses MEMS shutters instead of liquid crystal display elements. The present invention may also be applied to spontaneous emission type display apparatuses, such as an organic EL display apparatus and a plasma display apparatus.

Overview

Embodiment 1 is a display apparatus which displays an image by individually controlling the brightness value (brightness; quantity of light) of each of the plurality of light sources, where the brightness value of each light source is individually corrected based on the temperature information acquired by a temperature sensor unit. This temperature sensor unit includes a plurality of temperature sensors which correspond to a plurality of positions in a display module (display module that displays an image by causing the plurality of light sources to emit light) respectively. Then based on a plurality of temperature values (temperatures) detected by the plurality of temperature sensors respectively and the dispersion of the plurality of temperature values, the brightness value of each light source is individually corrected. Hereafter the temperature value detected by the temperature sensor, that is, the detection value of the temperature sensor, is referred to as the "sensor temperature value". By considering not only the plurality of sensor temperature values but also the dispersion of the plurality of sensor temperature values as well, the brightness value of each light source can be corrected at high precision, even if a margin of error caused by the brightness value of each light source is included in each sensor temperature value. For example, the brightness change of each light source caused by the temperature change of each light source can be suppressed at high precision.

Configuration of Display Apparatus

Figure 1:
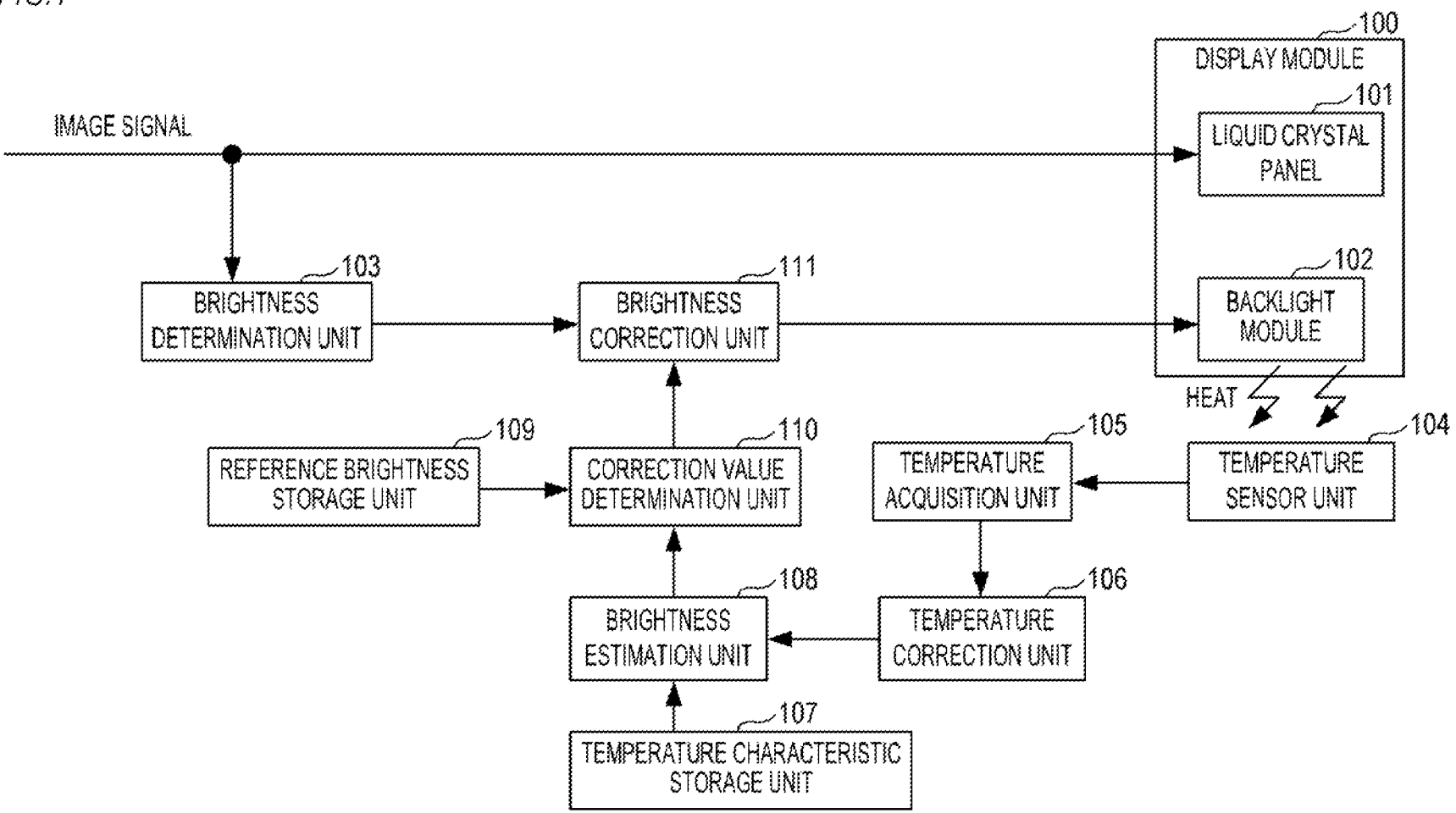
FIG. 1 is a block diagram of a display apparatus according to Embodiment 1.

FIG. 1 is a block diagram depicting a configuration example of the display apparatus according to Embodiment 1. The display apparatus includes a display module 100, a brightness determination unit 103, a temperature sensor unit 104, a temperature acquisition unit 105, a temperature correction unit 106, a temperature characteristic storage unit 107, a brightness estimation unit 108, a reference brightness storage unit 109, a correction value determination unit 110, and a brightness correction unit 111.

The display module 100 includes a plurality of light sources, and displays an image on a display surface of the display module 100 by causing the plurality of light sources to emit light based on input image signals (image signals inputted to the display apparatus). In Embodiment 1, the display module 100 includes a liquid crystal panel 101 and a backlight module 102.

The liquid crystal panel 101 displays an image on a display surface (front surface) of the liquid crystal panel 101 by allowing the light emitted from the backlight module 102 to transmit through at a transmittance (transmittance distribution) based on the input image signals.

The backlight module 102 is a light-emitting unit (light-emitting module) that irradiates light to the liquid crystal panel 101 (rear surface of liquid crystal panel 101). The light-emitting region (region where light is emitted) of the backlight module 102 is constituted of a plurality of control regions (plurality of sub-regions), and the backlight module 102 includes a plurality of light sources which correspond to the plurality of control regions respectively. Each light source includes at least one light-emitting element, and a light-emitting diode (LED) or the like is used for the light-emitting element. Each light source is driven in accordance with a corrected control value outputted from the brightness correction unit 111, and emits light at a brightness in accordance with the corrected control value.

Figure 2:
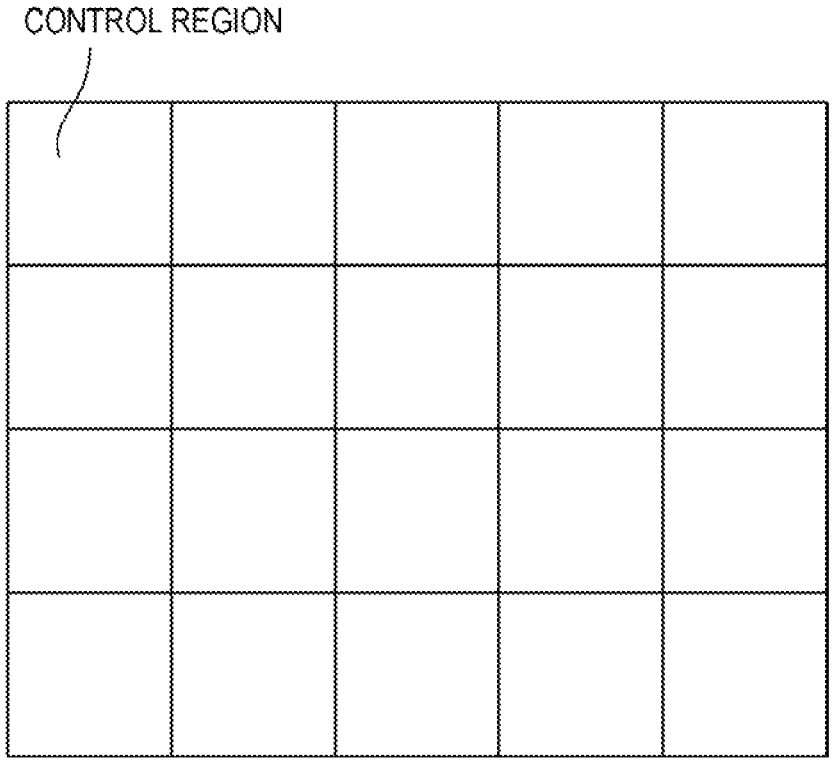
FIG. 2 is a schematic diagram of a control region according to Embodiment 1.

FIG. 2 is a schematic diagram depicting an example of the plurality of control regions. An arrangement, a number and a shape of the control regions are not especially limited, but in the case of FIG. 2, the light-emitting region of the backlight module 102 is constituted of 20 control regions which are arranged in a matrix of 5 rows and 4 columns.

In the case of the spontaneous emission type display apparatus, the display module 100 is a spontaneous emission type display panel (e.g. organic EL display panel or plasma display panel). In other words, the spontaneous emission type display panel, which is the display module 100, includes such light sources as organic EL elements or plasma elements.

The brightness determination unit 103 individually determines the brightness of each control region (each light source) of the backlight module 102 in accordance with the input image signal. The brightness of each control region can be determined using various prior arts. For example, a plurality of sub-display regions constituting the display region (region where an image is displayed, out of the display surface) corresponds to a plurality of control regions respectively. The brightness determination unit 103 determines the brightness of the control region corresponding to each sub-display region in accordance with the image signal used for display on this sub-display region. Such processing is performed for each control region individually.

In Embodiment 1, as a control value to control the brightness of each control region (light source) of the backlight module 102, the brightness determination unit 103 determines a plurality of control values which correspond to a plurality of control regions respectively in accordance with the input image signals. The brightness determination unit 103 outputs the determined plurality of control values to the brightness correction unit 111. Hereafter a control value corresponding to a control region at the m-th row and n-th column (control value to control the brightness value of the light source at the m-th row and n-th column) is called a "control value Hmn".

The temperature sensor unit 104 includes a plurality of temperature sensors which correspond to a plurality of positions of the display module 100 (display region; light-emitting region) respectively. In Embodiment 1, it is assumed that the temperature sensor unit 104 includes a plurality of temperature sensors which correspond to the plurality of control regions respectively. Each temperature sensor is used to detect the temperature of the display module 100 at a corresponding position, that is, to detect the temperature of the corresponding control region (light source). The temperature sensor unit 104 outputs a plurality of temperature values (plurality of sensor temperature values: plurality of detection values), detected by the plurality of temperature sensors respectively, to the temperature acquisition unit 105. Hereafter a sensor temperature value of a control region at the m-th row and the n-th column is called a "sensor temperature value Tmn".

The temperature acquisition unit 105 repeatedly performs a processing (at predetermined time intervals S) acquiring a plurality of sensor temperature values Tmn (a plurality of detection values) from the temperature sensor unit 104, and outputting the plurality of sensor temperature values Tmn to the temperature correction unit 106 as a plurality of sensor temperature values TKmn. The sensor temperature value TKmn is a sensor temperature value of a control region at the m-th row and the n-th column. The time interval S is not especially limited, but is 15 seconds in Embodiment 1. It is preferable that the time interval S is determined based on a number of temperature sensors, and it is preferable that the time interval S is longer as a number of the temperature sensors is higher. It is also preferable that the time interval S is determined based on the maximum brightness value (upper limit brightness value) of the display module 100 (light sources). It is also preferable that the time interval S is shorter as the maximum brightness value is higher, since the temperature change of the display module 100 per unit time tends to be larger as the maximum brightness value is higher.

Based on the dispersion of the plurality of sensor temperature values TKmn (a plurality of detection values) outputted from the temperature acquisition unit 105, the temperature correction unit 106 corrects the plurality of sensor temperature values TKmn to a plurality of sensor temperature values TLmn. The sensor temperature value TLmn is a corrected sensor temperature value of the control region at the m-th row and the n-th column. The temperature correction unit 106 outputs the plurality of sensor temperature values TLmn to the brightness estimation unit 108.

The method of evaluating the dispersion of the plurality of sensor temperature values TKmn is not especially limited, but in Embodiment 1, it is assumed that the difference between each of the plurality of sensor temperature values TKmn and the average temperature value Tavg, which is an average of the plurality of sensor temperature values TKmn, is used as the dispersion. In concrete terms, the temperature correction unit 106 calculates the sensor temperature value TLmn using the following Expressions 1 and 2.

$$Kmn=I(TKmn-Tavg) \quad \text{(Expression 1)}$$

$$TLmn=TKmn+(TKmn-Tavg)\times Kmn \quad \text{(Expression 2)}$$

The function I(TKmn−Tavg) of Expression 1 is a function to input the difference (TKmn−Tavg) and output the coefficient Kmn ($0 \le Kmn \le 1$). FIG. 3 is a table indicating the correspondence between the difference (TKmn−Tavg) and the coefficient Kmn. In Embodiment 1, a larger coefficient Kmn is calculated as the dispersion is larger in the portion of the display module 100 corresponding to the sensor temperature value TKmn (control region at the m-th row and the n-th column). In concrete terms, as indicated in FIG. 3, a small coefficient Kmn is calculated if the difference (TKmn−Tavg) is small, and a large coefficient Kmn is calculated if the difference (TKmn−Tavg) is large. Using such a coefficient Kmn, each of the plurality of sensor temperature values TKmn is individually corrected (Expression 2).

Instead of the function I(TKmn−Tavg), the table in FIG. 3 may be used. In this case, the table may include all the combinations of the difference (TKmn−Tavg) and the coefficient Kmn, or may include only a part of the combinations. In the case of the table including only a part of the combinations, a combination that is not included in the table may be determined by interpolation (e.g. linear interpolation) using the plurality of combinations included in the table. By decreasing a number of combinations included in the table, the data size of the table can be decreased.

The temperature characteristic storage unit 107 stores a temperature characteristic table which indicates the temperature characteristic of the control region (light source) of the backlight module 102 (brightness change of the light source caused by the temperature change of the light source). In Embodiment 1, the temperature characteristic storage unit 107 stores a table (table data) indicated in FIG. 4 in advance. The table in FIG. 4 (temperature characteristic table) indicates the correspondence between the temperature and the brightness, and indicates the brightness values which are normalized so that the brightness at the normal temperature 23° C. is 1. The temperature characteristic table can be created by measuring the temperature value and the brightness value while changing the brightness value of the light source.

The brightness estimation unit 108 acquires the brightness value LAmn corresponding to the sensor temperature value TLmn from the temperature characteristic table, which is stored in the temperature characteristic storage unit 107 in advance, for each of the plurality of sensor temperature values TLmn outputted from the temperature correction unit 106. The brightness value LAmn is a brightness value (estimated value) of the control region (light source) at the m-th row and the n-th column. The brightness estimation unit 108 outputs the plurality of brightness values LAmn to the correction value determination unit 110.

The temperature characteristic table may include all the combinations of the temperature values and the brightness values, or may include only a part of the combinations. In the case of the temperature characteristic table including only a part of the combinations, a combination that is not included in the temperature characteristic table may be determined by interpolation (e.g. linear interpolation) using the plurality of combinations included in the temperature characteristic table. In the case of the temperature characteristic table including only a part of the combinations, it is preferable that the temperature characteristic table includes more combinations in a range (temperature range or brightness range) where the brightness change of the light source caused by the temperature change of the light source is large, compared with other ranges. Further, a function which indicates correlations between the temperature value and the brightness value may be used.

The reference brightness storage unit 109 stores a reference brightness table, which stores, for each control region (light source) of the backlight module 102, a brightness value LAtmn of this control region in the case of driving this control region at a reference control value. The brightness value LAtmn is a brightness value of the control region at the m-th row and n-th column, and is the brightness value LAmn acquired by the brightness estimation unit 108 in the state of driving all the control regions at the reference control value, for example. The reference control value is a control value by which the brightness of the light emitted from the display surface has a predetermined brightness value (e.g. 100 nit) in the state where the transmittance of the liquid crystal panel 101 has the maximum value (upper limit value), for example. The reference control value, the predetermined brightness value, the brightness value LAtmn and the like can be freely determined or changed for each display apparatus.

The correction value determination unit 110 determines a plurality of correction values CLmn from the plurality of brightness values LAmn outputted from the brightness estimation unit 108 and the plurality of reference brightness values LAtmn, which are stored in the reference brightness storage unit 109 in advance. The correction value CLmn is a correction value determined from the brightness value LAmn and the reference brightness LAtmn, and is a correction value to correct the control value Hmn determined by the brightness determination unit 103. In Embodiment 1, the correction value determination unit 110 calculates the correction value CLmn using the following Expression 3. The correction value determination unit 110 outputs the determined plurality of correction values CLmn to the brightness correction unit 111.

$$CLmn = LAmn \div LAtmn \quad \text{(Expression 3)}$$

The brightness correction unit 111 individually corrects the brightness value of each control region (each light source) of the backlight module 102. In Embodiment 1, the brightness value of each control region is individually corrected based on the plurality of sensor temperature values Tmn acquired by the temperature sensor unit 104 and the dispersion of the plurality of sensor temperature values Tmn. For example, the brightness value of each control region is individually corrected based on a plurality of sensor temperature values TLmn acquired by the temperature correction unit 106 (a plurality of sensor temperature values after correction based on the dispersion).

In concrete terms, the brightness correction unit 111 acquires the plurality of corrected control values HBmn by correcting the plurality of control values Hmn outputted from the brightness determination unit 103 using the plurality of correction values CLmn outputted from the correction value determination unit 110 respectively. The corrected control value HBmn is a control value acquired by correcting the control value Hmn, and is a control value corresponding to the control region at the m-th row and n-th column (control value to control the brightness value of the light source at the m-th row and the n-th column). In Embodiment 1, the brightness correction unit 111 calculates the corrected control value HBmn using the following Expression 4. The brightness correction unit 111 outputs the determined plurality of corrected control values HBmn to the backlight module 102 (a plurality of light sources).

$$HBmn = Hmn \times CLmn \quad \text{(Expression 4)}$$

All that is required here is that the brightness value of each control region is individually corrected based on the plurality of sensor temperature values Tmn and the dispersion of the plurality of sensor temperature values Tmn. Therefore it is acceptable that at least one of the plurality of intermediate data, such as the corrected sensor temperature values TLmn, the brightness values LAmn (estimate values) and the correction values CLmn, is not acquired.

Operation of Display Apparatus

Figure 5A:
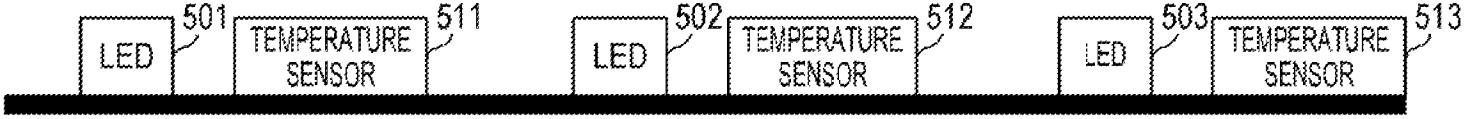
FIG. 5A is a diagram depicting an example of an arrangement of light sources and temperature sensors according to Embodiment 1.

FIG. 5A is a diagram depicting an example of an arrangement of the light sources (LED) of the backlight module 102 and temperature sensors of the temperature sensor unit 104. In FIG. 5A, the temperature sensor 511 corresponds to the LED 501, the temperature sensor 512 corresponds to the LED 502, and the temperature sensor 513 corresponds to the LED 503.

Figure 5B:
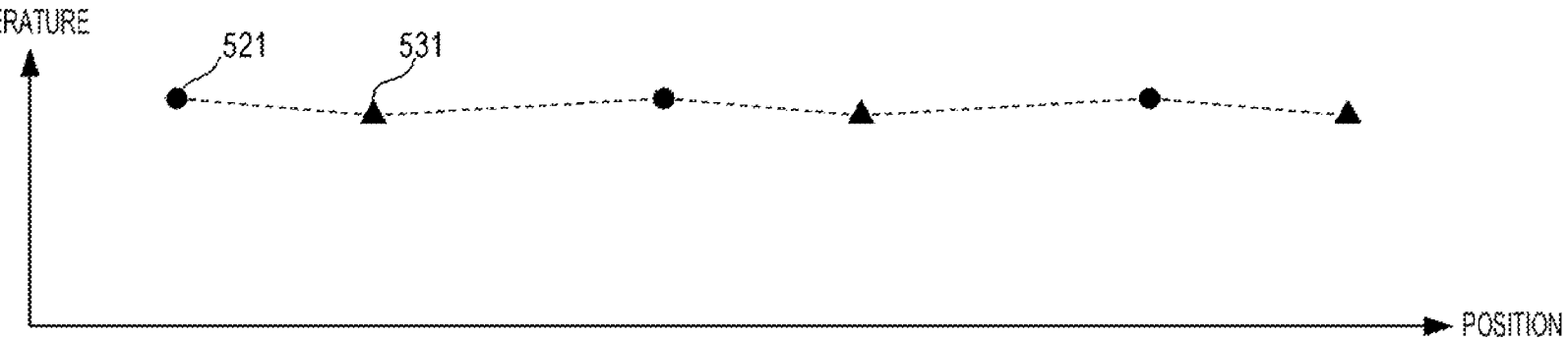
FIG. 5B and FIG. 5C are graphs depicting actual temperature values and sensor temperature values according to Embodiment 1.

FIG. 5B is a graph depicting an example of the actual temperature values of the LEDs 501 to 503 in the case of the LD control OFF (LD control is not performed) and the sensor temperature values (sensor temperature value Tmn; detection value) of the temperature sensors 511 to 513. In the local diming (LD) control, the brightness of each light source is individually controlled based on the input image signal. In the case of the LD control OFF, the plurality of light sources emit light at similar brightness values. Here it is assumed that each of the LEDs 501 to 503 emits light at 100 nit. If a plurality of light sources emit light at similar brightness values, the sensor temperature value is approximately the same as the actual temperature value of each light source. For example, the sensor temperature value 531 of the temperature sensor 511 is approximately the same as the actual temperature value 521 of the LED 501. In other words, in the case of the LD control OFF, the sensor temperature value having a small margin of error can be detected using the temperature sensor.

Figure 5C:
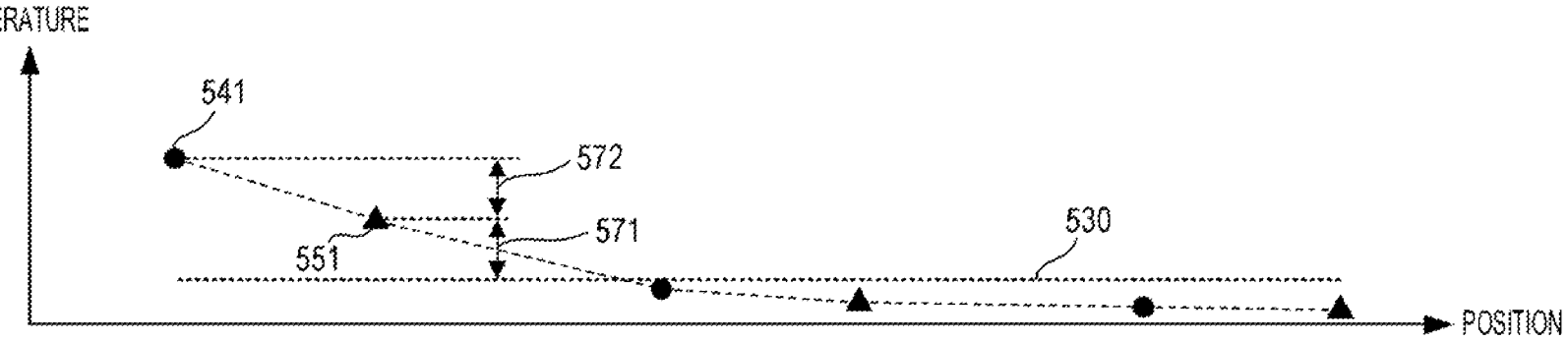

FIG. 5C is a graph depicting an example of the actual temperature values of LEDs 501 to 503 in the case of the LD control ON (LD control is performed), and the sensor temperature values of the temperature sensors 511 to 513. Here it is assumed that the LED 501 emits light at 100 nit, and each of the LEDs 502 and 503 is turned OFF (0 nit). In this case, the brightness value of the LED 501 is high, hence the actual temperature value 541 of the LED 501 is also high. However the brightness values of the LEDs 502 and 503 are low, hence compared with the case of the LD control OFF, the ratio of the heat dissipation value, with respect to the heat generation value of the LEDs 501 to 503, increases, and the temperature of the backlight module 102 generally decreases. Further, the heat generated in the LED 501 is dispersed to various directions, and the temperature distribution thereof becomes such that the temperature decreases as the distance from the LED 501 increases. For these reasons, the sensor temperature value 551 of the temperature sensor 511 near the LED 501 becomes much lower than the actual temperature value 541 of the LED 501. In other words, in the case of the LD control ON, a sensor temperature value that includes a non-negligible margin of error may be detected by the temperature sensor.

Therefore in Embodiment 1, the dispersion of the sensor temperature values of the temperature sensors 511 to 513 is considered. In FIG. 5C, the temperature 530 is an average temperature value of the sensor temperature values detected by the temperature sensors 511 to 513. The temperature difference 571 is a difference between the sensor temperature value 551 of the temperature sensor 511 and the average temperature 530, and the temperature difference 572 is a difference between the actual temperature value 541 of the LED 501 and the sensor temperature value 551 of the temperature sensor 511. Here it is assumed that the temperature difference 572 is the same as the temperature difference 571. It is also assumed that the coefficient Kmn=1 is calculated based on the temperature difference 571 using Expression 1 (the temperature difference 571 corresponds to the difference of Expressions 1 and 2 (TKmn −Tavg)). In this case, the temperature difference 571 is added to the sensor temperature value 551 using Expression 2 (correction of sensor temperature 551). Since the temperature difference 572 is the same as the temperature difference 571, the sensor temperature value that is the same as the actual temperature value 541 of the LED 501 can be acquired by this correction. As a result, the brightness value of the LED 501 can be corrected at high precision.

In this way, according to Embodiment 1, the brightness value of the light source can be corrected at high precision in the case of the LD control ON, even if a margin of error caused by the brightness value of the light source is included in the sensor temperature detected by the temperature sensor.

In the case of the LD control OFF, the dispersion of the sensor temperature values is small, and the temperature sensor can detect the sensor temperature values having a small margin of error, hence a major change in the sensor temperature values is unnecessary (major change increases the margin of error of the sensor temperature values). Similarly, even in the case of the LD control ON, if an image of which pixel values are approximately uniform within the display surface is displayed, dispersion of the sensor temperature values is small, and the temperature sensor can detect the sensor temperature values having a small margin of error, hence a major change in the sensor temperature value is unnecessary. On the other hand, if an image of which pixel values largely disperse within the display surface is displayed in the case of the LD control ON, dispersion of the sensor temperature values is large, and the temperature sensor detects the sensor temperature values having a large margin of error, hence a major change in the sensor temperature values is required.

Therefore in Embodiment 1, a small coefficient Kmn is calculated when the difference (TKmn−Tavg) is small, and a large coefficient Kmn is calculated when the difference (TKmn−Tavg) is large. Thereby in the case where the LD control is OFF or in the case where the dispersion of the sensor temperature values is small even if the LD control is ON, the coefficient Kmn can be set to a small value so that a major change in the sensor temperature values can be suppressed, and an increase in the margin of error of the sensor temperature values can be prevented. Further, in the case where the LD control is ON and the dispersion of the sensor temperature values is large, the coefficient Kmn can be set to a large value so that a major change of the sensor temperature values is performed, and the sensor temperature values having a small margin of error can be acquired.

As described above, according to Embodiment 1, the sensor temperature values having a small margin of error can be acquired whether the LD control is ON or OFF, and the brightness values of the light sources can be corrected at high precision.

Modification 1

Modification 1 of Embodiment 1 will be described. In Embodiment 1, an average of all the sensor temperature values TKmn is used as the average temperature Tavg for all the sensor temperature values TKmn. In other words, all the sensor temperature values TKmn are corrected using the same average temperature Tavg. In Modification 1, an average of a part of a plurality of sensor temperature values TKmn is used as the average temperature Tavg for each sensor temperature value TKmn. This average is an average of the sensor temperature values TKmn detected by this temperature sensor and the peripheral temperature sensors thereof.

Generally the size of the display surface of the display module 100, the maximum brightness value (upper limit brightness value) of the display module 100 (light source) and the like are different depending on the intended use and the price of the display apparatus. In this case, the density of the light sources (a number of light-emitting regions per unit area) and the heat generation value thereof may also be different. If the density and the heat generation value of the light sources change, a number of light sources that influence the sensor temperature value of one temperature sensor also changes. In other words, a number of temperature sensors of which sensor temperature values are influenced by one light source changes. Therefore it is preferable that the average temperature value Tavg, to be used for each light source, is an average of the sensor temperature values detected by the temperature sensors, of which sensor temperature values are influenced by this light source (temperature sensor corresponding to this light source and peripheral temperature sensors thereof). Thereby the temperature value of each light source can be estimated appropriately, even if the display size and the display brightness of the image changes.

Modification 2

Modification 2 of Embodiment 1 will be described. In Embodiment 1, a same number of temperature sensors as the light sources are disposed so that the light sources and the temperature sensors correspond one-to-one. In Modification 2 however, less number of sensors than the light sources are disposed by thinning out some temperature sensors.

Generally a number of light sources used for the display module 100 varies, from several tens to several thousands. If a number of light sources is small, the temperature sensor can be disposed for each light source (for each control region), but when a number of light sources is high, such as several thousands, it is difficult to dispose a temperature sensor for each light source. Therefore a temperature sensor may be disposed for each light source group which includes a plurality of light sources (a region group which includes a plurality of control regions), and the sensor temperature value of each light source may be acquired by interpolation (e.g. linear interpolation) using a plurality of sensor temperature values corresponding to a plurality of temperature sensors respectively. Thereby a case where a number of light sources (control regions) used for the display module 100 is high can be flexibly supported, and the brightness value of each light source can be appropriately corrected using a small number of temperature sensors.

Effect of Embodiment 1 (Including Modifications)

As described above, according to Embodiment 1, not only a plurality of sensor temperature values, but also the dispersion of the plurality of sensor values is considered, whereby the brightness value of each light source can be corrected at high precision, even if each sensor temperature includes a margin of error caused by the brightness value of each light source.

Embodiment 2

Embodiment 2 of the present invention will be described. In Embodiment 1, the brightness value of each light source is individually corrected considering a plurality of sensor temperature values and the dispersion of the plurality of sensor temperature values. In Embodiment 2, the brightness value of each light source is individually corrected with additionally considering the temperature of the peripheral area (ambient temperature) of the display apparatus. In the following, aspects (e.g. configuration, processing) that are different from Embodiment 1 will be described in detail, and description on aspects that are the same as Embodiment 1 will essentially be omitted.

Configuration of Display Apparatus

Figure 6:
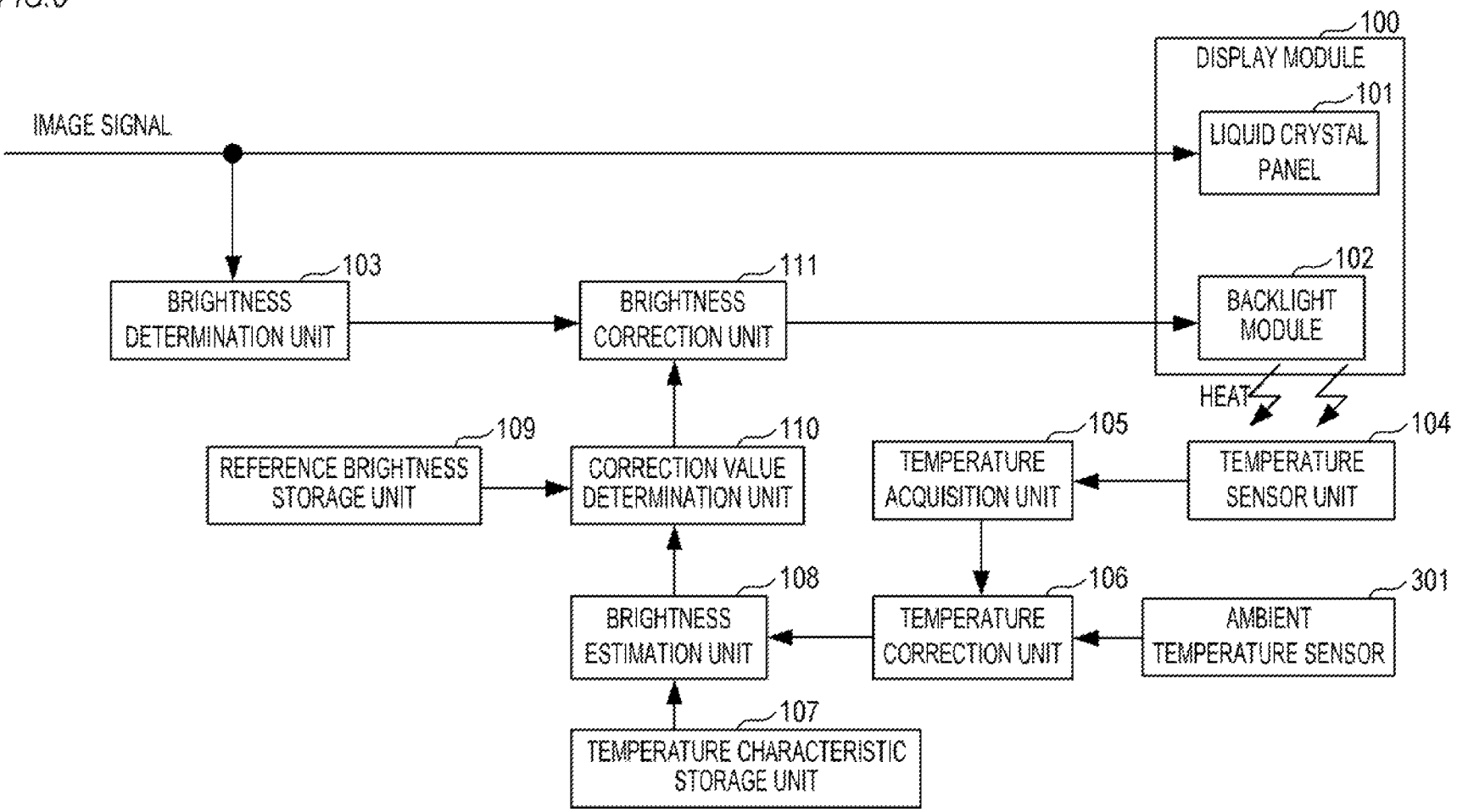
FIG. 6 is a block diagram of a display apparatus according to Embodiment 2.

FIG. 6 is a block diagram depicting a configuration example of the display apparatus according to Embodiment 2. The display apparatus according to Embodiment 2 includes an ambient temperature sensor 301 in addition to the composing elements of Embodiment 1 (FIG. 1). The ambient temperature sensor 301 is a temperature sensor that detects the temperature value TG of the peripheral area of the display apparatus (ambient temperature value; environment temperature value), and outputs the detected ambient temperature value TG (detection value) to the temperature correction unit 106.

Method of Correcting Sensor Temperature Values

Based on the dispersion of a plurality of sensor temperature values TKmn (a plurality of detection values) outputted from the temperature acquisition unit 105 and an ambient temperature value TG (detection value) outputted from the ambient temperature sensor 301, the temperature correction unit 106 corrects the plurality of sensor temperature values TKmn to a plurality of sensor temperature values TLmn. In concrete terms, the temperature correction unit 106 calculates the sensor temperature value TLmn using the following Expression 5 and 6. Expression 6 is the same as Expression 2 of Embodiment 1.

$$Kmn=I(TKmn-T\text{avg})(TG) \quad \text{(Expression 5)}$$

$$TLmn=TKmn+(TKmn-T\text{avg})\times Kmn \quad \text{(Expression 6)}$$

In Embodiment 2, a plurality of coefficient calculation functions, to input a difference (TKmn−Tavg) and output a coefficient Kmn are provided, and the function I(TKmn−Tavg)(TG) in Expression 5 is a coefficient calculation function corresponding to the ambient temperature value TG, out of the plurality of coefficient calculation functions. In other words, in Embodiment 2, the coefficient calculation function is switched in accordance with the ambient temperature value. The coefficient calculation function for each ambient temperature value is created in advance based on the result of measurement, which is performed while changing the ambient temperature value of the display apparatus.

Generally the display apparatus is equipped with a plurality of fans (cooling fans) so as to handle the changes of the ambient temperature and internal temperature of the display apparatus. These fans may rotate at high-speed when the display apparatus is located in a high temperature environment (e.g. 30° C. or more), so that the display apparatus is not damaged. The air flow inside the display apparatus is totally different between the case where the fans are rotating at high-speed and the case where the fans are rotating at low-speed, hence in-plane temperature distribution on the display module 100 is also different there between. Further, a margin of error included in the sensor temperature value TKmn (difference between the sensor temperature value TKmn and the actual temperature value) greatly differs between the case where the fans are rotating at high-speed and the case where the fans are rotating at low-speed. This means that if the coefficient calculation function created in the state where the fans are rotating at low-speed is used in the state where the fans are rotating at high-speed, the sensor temperature values TKmn cannot be corrected appropriately (sensor temperature values TLmn having a large margin of error are acquired), and the brightness of the light sources cannot be corrected appropriately. Therefore in Embodiment 2, the ambient temperature sensor 301 is disposed, and the coefficient calculation function is switched in accordance with the ambient temperature value TG detected by the ambient temperature sensor 301. As a result, even if the heat dissipation performance changes due to a change in the rotation speed of the fans, the sensor temperature values TKmn are corrected at high precision, and the brightness values of the light sources can be corrected at high precision.

Effect of Embodiment 2

As described above, according to Embodiment 2, the ambient temperature values of the display apparatus are detected and the detected ambient temperature values are further considered, whereby the brightness value of each light source can be corrected with certainty at high precision.

Embodiment 3

Embodiment 3 of the present invention will be described. In Embodiment 1, the difference between each sensor temperature value and the average temperature value (average of the plurality of sensor temperature values) is used as a dispersion of the plurality of sensor temperature values. In Embodiment 3, a temperature value of the heat dissipation member, which dissipates the heat of the display module (heat dissipation temperature value) is detected, and the difference between each sensor temperature value and the heat dissipation temperature value is used as the dispersion of the plurality of sensor temperature values. In the following, aspects (e.g. configuration, processing) that are different from Embodiment 1 will be described in detail, and description on aspects that are the same as Embodiment 1 will essentially be omitted.

Configuration of Display Apparatus

Figure 7:
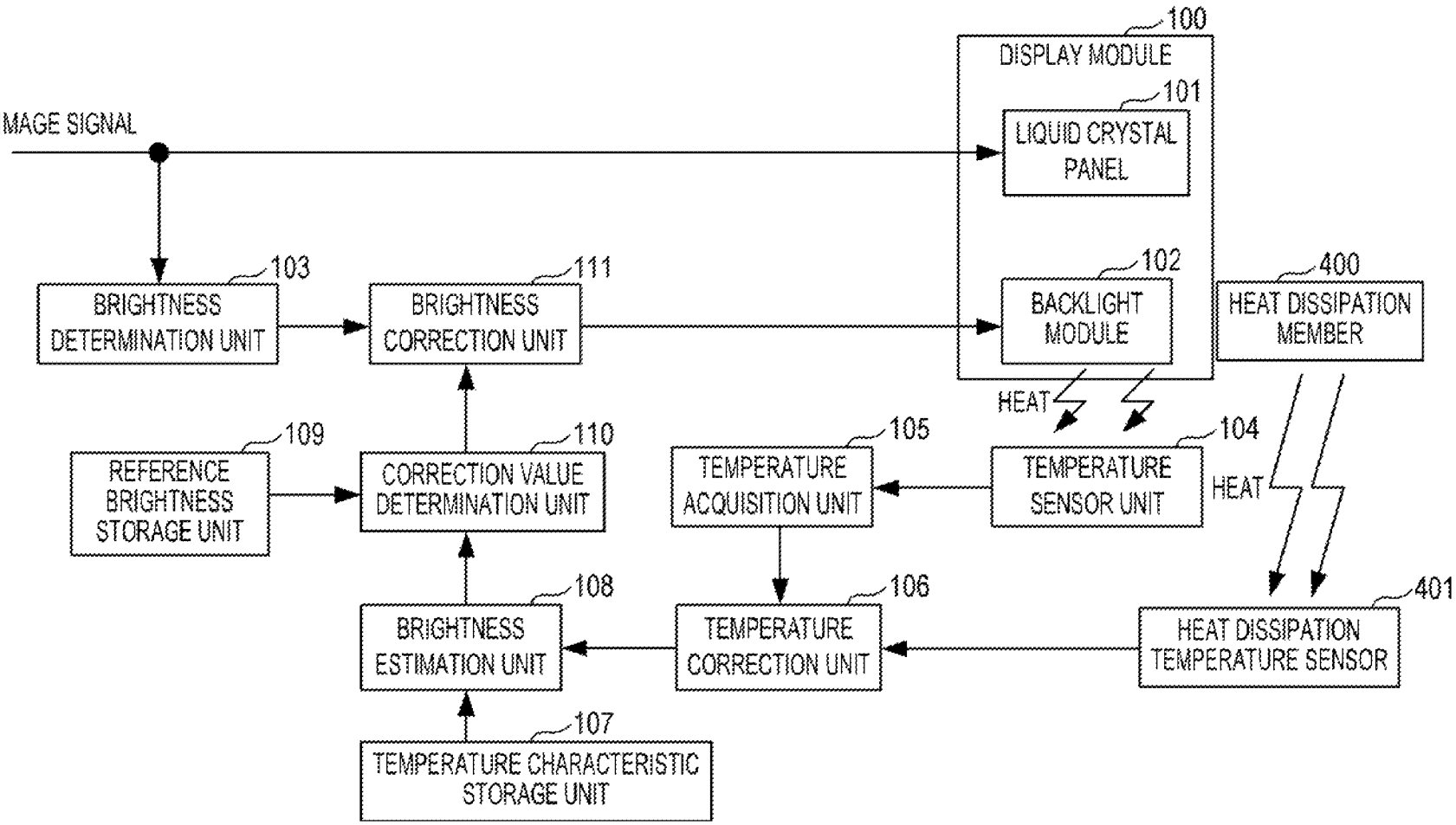
FIG. 7 is a block diagram of a display apparatus according to Embodiment 3.

FIG. 7 is a block diagram depicting a configuration example of the display apparatus according to Embodiment 3. The display apparatus according to Embodiment 3 includes a heat dissipation member 400 and a heat dissipation temperature sensor 401, in addition to the composing elements of Embodiment 1 (FIG. 1). The heat dissipation member 400 is a member that dissipates the heat of the display module 100, and is a heat sink installed on the rear surface of the backlight module 102, for example. The heat dissipation temperature sensor 401 is a temperature sensor that detects the temperature value TH (heat dissipation temperature value) of the heat dissipation member, and outputs the detected heat dissipation temperature value TH (detection value) to the temperature correction unit 106.

Method of Correcting Sensor Temperature Values

In Embodiment 3, the temperature correction unit 106 corrects a plurality of sensor temperature values TKmn (a plurality of detection values) outputted from the temperature acquisition unit 105 to a plurality of sensor temperature values TLmn, just like Embodiment 1. However, as the dispersion of the plurality of sensor temperature values TKmn, the temperature correction unit 106 uses the difference between each sensor temperature value TKmn and the heat dissipation temperature value TH outputted from the heat dissipation temperature sensor 401. In concrete terms, the temperature correction unit 106 calculates the sensor temperature value TLmn using the following Expressions 7 and 8. The function I (TKmn−TH) of Expression 7 is a function to input the difference (TKmn−TH) and output the coefficient Kmn.

$$Kmn=I(TKmn-TH) \quad \text{(Expression 7)}$$

$$TLmn=TKmn+(TKmn-TH)\times Kmn \quad \text{(Expression 8)}$$

Generally the heat dissipation member 400 (heat sink) is disposed on the entire rear surface of the display module 100, and because of the heat dissipation member 400, the heat from all the light sources is released from the entire rear surface of the display module 100 (heat dissipation). Therefore the heat dissipation temperature value TH of the heat dissipation member 400 is in proportion to the total heat generation value and the average heat generation value of the display module 100. The heat dissipation temperature value TH is approximately the same as the average temperature Tavg of Embodiment 1. Therefore in Embodiment 3, the heat dissipation temperature value TH is used instead of the average temperature value Tavg, as indicated in Expressions 7 and 8. Since the heat dissipation temperature value TH is approximately the same as the average temperature value Tavg of Embodiment 1, effects equivalent to Embodiment 1 is acquired, even if the heat dissipation temperature value TH is used instead of the average temperature value Tavg.

Modification

Modification of Embodiment 3 will be described. In Embodiment 3, the temperature value of the heat dissipation member that dissipates the heat of the display module (heat dissipation temperature value) is detected, and the heat dissipation temperature value (detection value) is used instead of the average temperature value (average of a plurality of sensor temperature values). In this modification, in a configuration of cooling the display module by a fan, a temperature value in accordance with the fan drive voltage (voltage applied to a fan) or the fan rotation speed (rotation speed of a fan) is used, instead of the average temperature value or the heat dissipation temperature value. In other words, the difference between each sensor temperature value and a temperature value in accordance with the fan drive voltage or the heat dissipation temperature is used for the dispersion of the plurality of sensor temperature values.

Generally the display apparatus includes a fan that cools the display module and a control circuit that controls the rotation speed of this fan (fan rotation speed) by controlling the voltage to be applied to the fan (fan drive voltage). The average temperature value Tavg and the heat dissipation temperature value TH are highly correlated with the fan drive voltage value and the fan rotation speed. Therefore the fan drive voltage value and the fan rotation speed value can be converted into temperature values that are equivalent to the average temperature value Tavg and the heat dissipation temperature value TH, and can be used instead of the average temperature value Tavg and the heat dissipation temperature value TH. With this configuration, effects similar to Embodiment 1 can also be acquired.

Effect of Embodiment 3 (Including Modification)

As described above, according to Embodiment 3, the heat dissipation temperature (detection value) is used instead of the average temperature value (average of a plurality of sensor temperature values), or the temperature value in accordance with the fan drive voltage value or the fan rotation speed value is used. Thereby an effect similar to Embodiment 1 can be acquired.

Embodiment 4

Embodiment 4 of the present invention will be described. In Embodiment 1, the plurality of sensor temperature values are individually corrected based on the dispersion of the plurality of sensor temperature values. In Embodiment 4, the sensor temperature values are not corrected, but the correction parameters, which are used to individually correct the brightness value of each light source based on a plurality of sensor temperature values, are switched depending on the above mentioned dispersion. The correction parameters are not especially limited, but it is assumed that a temperature characteristic table is used in Embodiment 4. In the following, aspects (e.g. configuration, processing) that are different from Embodiment 1 will be described in detail, and description on the aspects that are the same as Embodiment 1 will essentially be omitted.

Configuration of Display Apparatus

Figure 8:
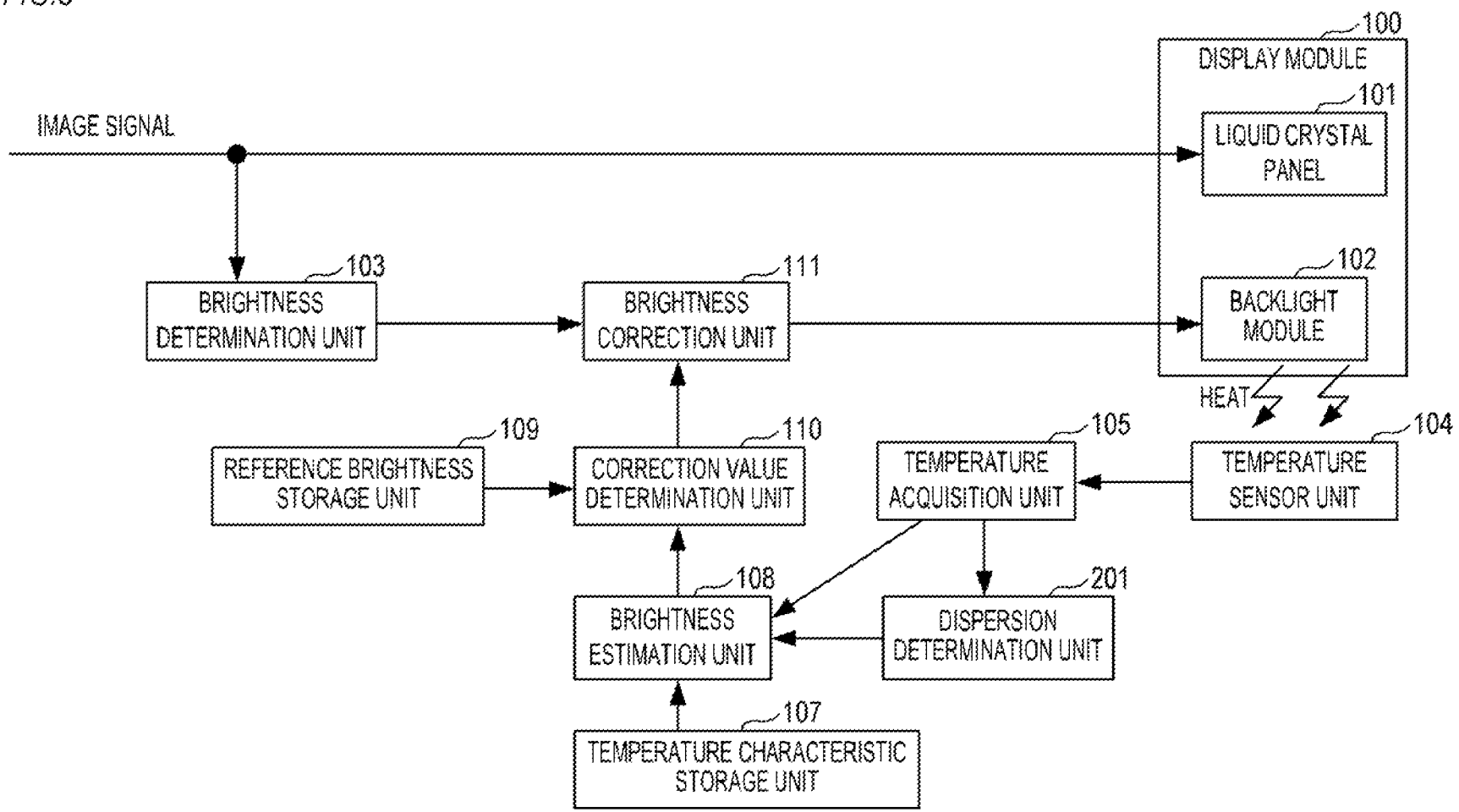
FIG. 8 is a block diagram of a display apparatus according to Embodiment 4.

FIG. 8 is a block diagram depicting a configuration example of the display apparatus according to Embodiment 4. In the display apparatus according to Embodiment 4, the temperature correction unit 106 in the composing elements in Embodiment 1 (FIG. 1) is replaced with a dispersion determination unit 201. The dispersion determination unit 201 determines the dispersion of the plurality of sensor temperature values TKmn which are outputted from the temperature acquisition unit 105, and outputs the determination result to the brightness estimation unit 108. In Embodiment 4, the dispersion determination unit 201 calculates the difference between each of the plurality of sensor temperature values TKmn and the average temperature value Tavg, and outputs the plurality of calculated temperature difference values (TKmn−Tavg) to the brightness estimation unit 108. Hereafter the temperature difference value (TKmn−Tavg) corresponding to a control region at the m-th row and n-th column is called "temperature difference value TPmn".

Method of Switching Temperature Characteristic Table

In Embodiment 4, the temperature characteristic table is stored in the temperature characteristic storage unit 107 in advance, just like Embodiment 1. In the temperature characteristic storage unit 107, however, a plurality of temperature characteristic tables corresponding to a plurality of possible temperature difference values TPmn respectively are stored in advance.

In Embodiment 4, for each of the plurality of sensor temperature values TKmn outputted from the temperature acquisition unit 105, the brightness estimation unit 108 acquires a brightness value LAmn corresponding to the sensor temperature value TKmn from the temperature characteristic tables stored in the temperature characteristic storage unit 107 in advance. Here the brightness estimation unit 108 acquires the brightness value LAmn from the temperature characteristic table corresponding to the temperature difference value TPmn outputted from the dispersion determination unit 201. In other words, the brightness estimation unit 108 uses the temperature characteristic table switched in accordance with the temperature difference value TPmn.

By switching the temperature characteristic table, as mentioned above, the temperature value of the control region (light source) at the m-th row and the n-th column can be estimated at high precision from the sensor temperature value TKmn without correcting the sensor temperature value TKmn, whereby an effect similar to Embodiment 1 can be acquired.

Modification

Modification of Embodiment 4 will be described. In Embodiment 4, a plurality of temperature characteristic tables corresponding to a plurality of possible temperature difference values TPmn are provided in advance, and a temperature characteristic table is selected and used in accordance with the temperature difference value TPmn. In this modification, two temperature characteristic tables are provided in advance, and one of the temperature characteristic tables is selected and used depending on whether the operation mode in which dispersion of the plurality of sensor temperature values TKmn is generated, is set in the display apparatus. In this modification, it is assumed that the operation mode, in which dispersion of the plurality of sensor temperature values TKmn is generated, is the LD control ON mode in which the LD control is performed.

Generally there are various display apparatuses which can perform the LD control, such as a high end display apparatus which is used by professionals and which has high brightness stability, and a low end display apparatus which is used by general users and which has low brightness stability. Therefore is a need in which the function to switch the temperature characteristic tables, as described in Embodiment 4, is installed using a simple configuration, even if the effect is not at the maximum. To meet this need, in this modification, two temperature characteristic tables are provided, that is: a temperature characteristic table suitable for the LD control ON mode in which the LD control is performed (LD table); and a temperature characteristic table suitable for the LD control OFF mode in which the LD control is not performed (non-LD table). The LD table is used when the LD control ON mode is set, and the non-LD table is used when the LD control ON mode is not set (that is, the LD control OFF mode is set). The effect equivalent to Embodiment 1 can be acquired as well by this simple configuration. In concrete terms, the brightness value of each light source can be corrected at a certain degree of precision, even if a margin of error caused by the brightness value of each light source is included in each sensor temperature value. It is preferable that the LD table is a temperature characteristic table which indicates the brightness value of each light source, when the dispersion is at the medium level (temperature difference value TPmn is about midway of the plurality of possible values).

Effect of Embodiment 4 (Including Modification)

As described above, according to Embodiment 4, the correction parameters, which are used for individually correcting the brightness value of each light source based on the plurality of sensor temperature values, are switched depending on the dispersion of the plurality of sensor temperature values. Thereby an effect similar to Embodiment 1 (effect equivalent to Embodiment 1) can be acquired without correcting the sensor temperature values.

Each composing element of Embodiments 1 to 4 (including modifications) may or may not be independent hardware. The functions of at least two blocks may be implemented by common hardware. Each of a plurality of functions of one block may be implemented by independent hardware. At least two functions of one block may be implemented by common hardware. Each block may or may not be implemented by hardware. For example, the apparatus may include a processor and a memory that stores a control program. The functions of at least a part of the blocks of the apparatus may be implemented by a processor reading the control program from the memory, and executing the control program.

Embodiments 1 to 4 (including modifications) are merely examples, and configurations implemented by appropriately modifying or changing the configurations of Embodiments 1 to 4 within the scope of the essence of the present invention are included in the present invention. Further, configurations implemented by appropriately combining the configurations of Embodiments 1 to 4 are also included in the present invention.

According to this disclosure, the brightness value of the light source can be corrected at high precision, even if a margin of error caused by the brightness value of the light source is included in the sensor temperature value (detection value of the temperature sensor; temperature value detected by the temperature sensor).

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-138736, filed on Jul. 29, 2019, which is hereby incorporated by reference herein in its entirety.

What is claimed is:

1. A display apparatus comprising:

a display module configured to display an image by causing a plurality of light sources to emit light;

a plurality of temperature sensors corresponding to a plurality of positions in the display module respectively; and at least one memory and at least one processor which function as: a correction unit configured to individually correct each of brightnesses of the plurality of light sources based on a plurality of temperatures detected by the plurality of temperature sensors respectively and dispersion of the plurality of temperatures, wherein the correction unit includes:

a temperature correction unit configured to individually correct each of the plurality of temperatures based on the dispersion; and a brightness correction unit configured to individually correct each of the brightnesses of the plurality of light sources based on the plurality of corrected temperatures.

2. The display apparatus according to claim 1, wherein the display module includes: a backlight including the plurality of light sources; and a display panel configured to display the image by transmitting the light emitted from the plurality of light sources.

3. The display apparatus according to claim 2, wherein each of the plurality of light sources is an LED.

4. The display apparatus according to claim 1, wherein the plurality of temperature sensors correspond to the plurality of light sources respectively.

5. The display apparatus according to claim 1, wherein the temperature correction unit corrects each of the plurality of temperatures using a larger coefficient as the dispersion is larger in a portion of the display module corresponding to this temperature.

6. The display apparatus according to claim 1, further comprising:

a first sensor configured to detect a temperature around the display apparatus, wherein the correction unit individually corrects each of the brightnesses of the plurality of light sources based on the plurality of temperatures, the dispersion and the temperature detected by the first sensor.

7. The display apparatus according to claim 1, wherein the correction unit uses a difference between each of the plurality of temperatures and an average of the plurality of temperatures, as the dispersion.

8. The display apparatus according to claim 1, wherein, the correction unit uses a difference between each of the plurality of temperatures and an average of a part of the plurality of temperatures, at the dispersion, and for each of the plurality of temperatures, an average of the temperatures detected by the temperature sensor which detected this temperature and the peripheral temperature sensor thereof is used as the average of the part of the plurality of temperatures.

9. The display apparatus according to claim 1, further comprising:

a heat dissipation member configured to dissipate heat of the display module; and a second sensor configured to detect a temperature of the heat dissipation member, wherein the correction unit uses a difference between each of the plurality of temperatures and the temperature detected by the second sensor, as the dispersion.

10. The display apparatus according to claim 1, further comprising:

a fan configured to cool the display module, wherein the at least one memory and at least one processor further function as: a control unit configured to control a rotation speed of the fan by controlling voltage to be applied to the fan, and the correction unit uses a difference between each of the plurality of temperatures and a temperature in accordance with the voltage to be applied to the fan or the rotation speed of the fan, as the dispersion.

11. The display apparatus according to claim 1, wherein the correction unit switches, based on the dispersion, a correction parameter which is used for individually correcting each of the brightnesses of the plurality of light sources based on the plurality of temperatures.

12. The display apparatus according to claim 11, wherein the display module includes: a backlight including the plurality of light sources; and a display panel configured to display the image by transmitting the light emitted from the plurality of light sources, and the correction unit switches the correction parameter depending on whether a local dimming mode is on or off.

13. A control method of a display apparatus including: a display module configured to display an image by causing a plurality of light sources to emit light; and a plurality of temperature sensors corresponding to a plurality of positions in the display module respectively, the control method comprising:

acquiring a plurality of temperatures detected by the plurality of temperature sensors respectively;

individually correcting each of the plurality of temperatures based on dispersion of the plurality of temperatures; and individually correcting each of brightnesses of the plurality of light sources based on the plurality of corrected temperatures.

14. A non-transitory computer readable medium that stores a program, wherein the program causes a computer to execute a control method of a display apparatus including: a display module configured to display an image by causing a plurality of light sources to emit light; and a plurality of temperature sensors corresponding to a plurality of positions in the display module respectively, the control method comprising:

acquiring a plurality of temperatures detected by the plurality of temperature sensors respectively;

individually correcting each of the plurality of temperatures based on dispersion of the plurality of temperatures; and individually correcting each of brightnesses of the plurality of light sources based on the plurality of corrected temperatures.

* * * * *